US006357567B1

(12) United States Patent
Tsai

(10) Patent No.: US 6,357,567 B1
(45) Date of Patent: Mar. 19, 2002

(54) LUGGAGE

(76) Inventor: James Tsai, No. 103, Ta-Ming 1 Rd., Tung Pao Village, Tan Tsu Hsian, Taichung Hsien (TW)

( * ) Notice: Subject to any disclaimer, the term of this patent is extended or adjusted under 35 U.S.C. 154(b) by 0 days.

(21) Appl. No.: 09/730,807

(22) Filed: Dec. 7, 2000

(51) Int. Cl.[7] ..... A45C 5/00

(52) U.S. Cl. ..... 190/18 A; 190/115; 190/103; 190/107; 190/127; 280/47.2; 16/113.1

(58) Field of Search ..... 190/18 A, 115, 190/127, 103, 107; 280/47.2; 16/113.1, 113.2

(56) References Cited

U.S. PATENT DOCUMENTS 4,822,070 A * 4/1989 Korona et al. ..... 280/47.2
5,353,900 A * 10/1994 Stilley ..... 190/18 A
5,782,325 A * 7/1998 O'Shea et al. ..... 190/18 A
5,873,439 A * 2/1999 Liang ..... 190/18 A
5,884,362 A * 3/1999 Tsai ..... 16/113.1
6,179,101 B1 * 1/2001 Lin ..... 190/115 X
6,182,981 B1 * 2/2001 Kuo ..... 190/18 A X

* cited by examiner

*Primary Examiner*—Stephen K. Cronin
*Assistant Examiner*—Tri M. Mai
(74) *Attorney, Agent, or Firm*—Browdy and Neimark P.L.L.C.

(57) ABSTRACT

A luggage includes a frame body defining a holding space, the frame body having a main frame unit and a side frame unit pivoted to the main frame unit with an angle; a bag body, having at least one part installed in the holding space in the frame body; a handle for holding by the user; two wheel assemblies bilaterally mounted on a bottom side of the frame body, a main locating member and two upper locating members and two bottom locating members adapted to secure the bag body to the frame body, the locating members each having an interior piece attached to the inside of the bag body and an exterior piece attached to the outside of the bag body and fixedly fastened to the interior piece to secure the bag body to the frame body.

9 Claims, 8 Drawing Sheets

LUGGAGE

BACKGROUND OF THE INVENTION

The present invention relates to luggage and, more particularly, to an innovative design of luggage.

FIG. 1 shows a conventional luggage case. This design of luggage case cart comprises a rectangular frame body 70, which supports the luggage in shape, a flexible fabric covering covered on the frame body 70 to form outside walls 71 and 72 of the luggage. The flexible fabric covering defines a storage space 73 for holding goods, clothes, and etc. One outside wall 72 has a zipper 721, which controls the entrance of the storage space 73. The luggage comprises two wheel assemblies 74 at the bottom side, a carrying handle 75 at the center of the top side, and a retractable handle 76 near the back side. This structure of luggage case cart is heavy. Further, the monotonous design of this structure of luggage case is boring the consumer.

SUMMARY OF THE INVENTION

The primary objective of the present invention is therefore to provide an innovative design of luggage, which attract consumers' attention.

In keeping with the principle of the present invention, the luggage of the present invention comprises a frame body defining a holding space, the frame body having a main frame unit and a side frame unit which with one end connected to the main frame unit at an predetermined angle; a bag body, having at least one part installed in the holding space in the frame body; a handle, for holding by the user; two wheel assemblies bilaterally mounted on a bottom side of the frame body, and locating means adapted to secure the bag body to the frame body.

DETAILED DESCRIPTION OF THE PREFERRED EMBODIMENT

Figure 1:
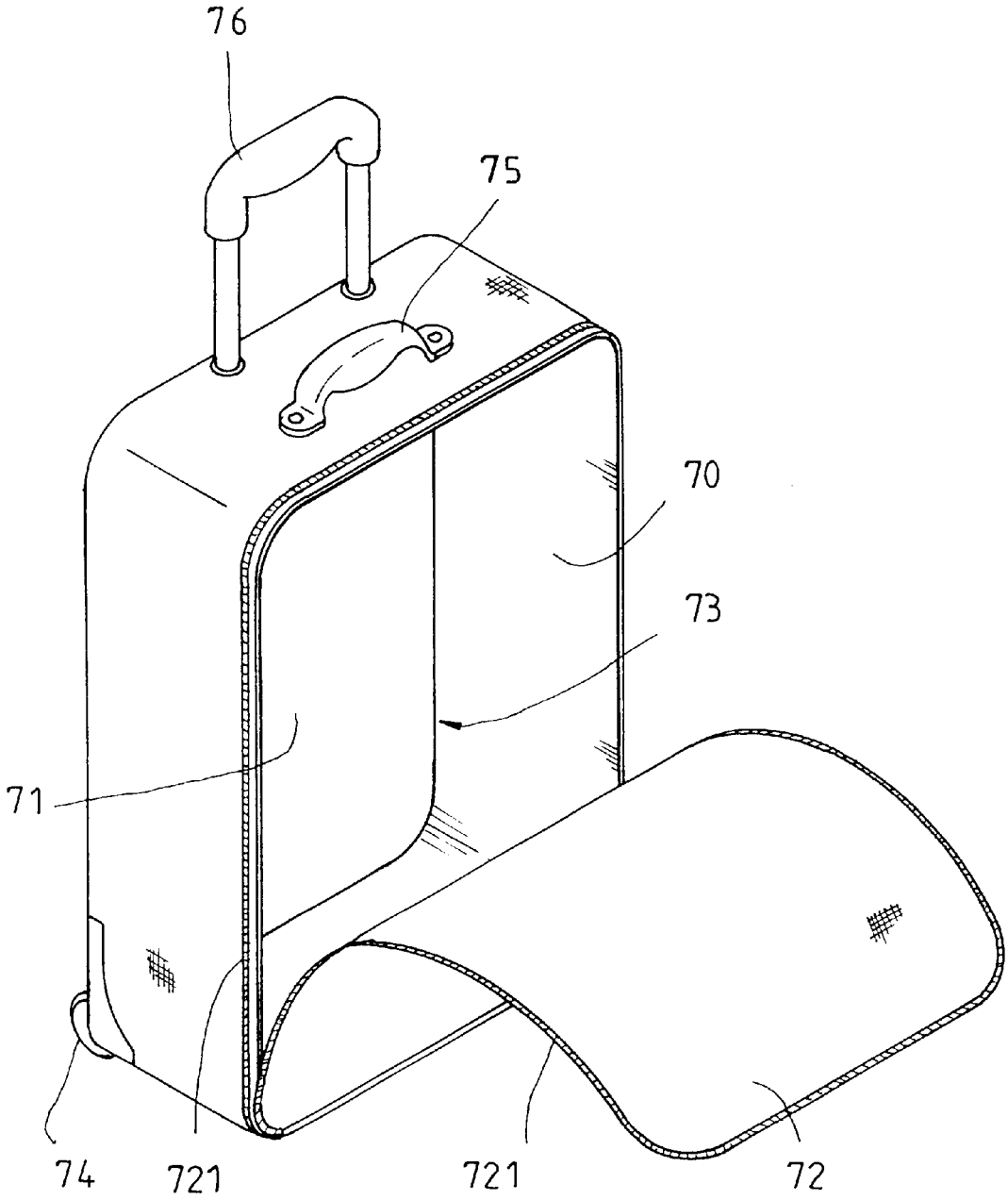
FIG. 1 PRIOR ART
FIG. 1 illustrates a luggage case cart according to the prior art.
Figure 2:
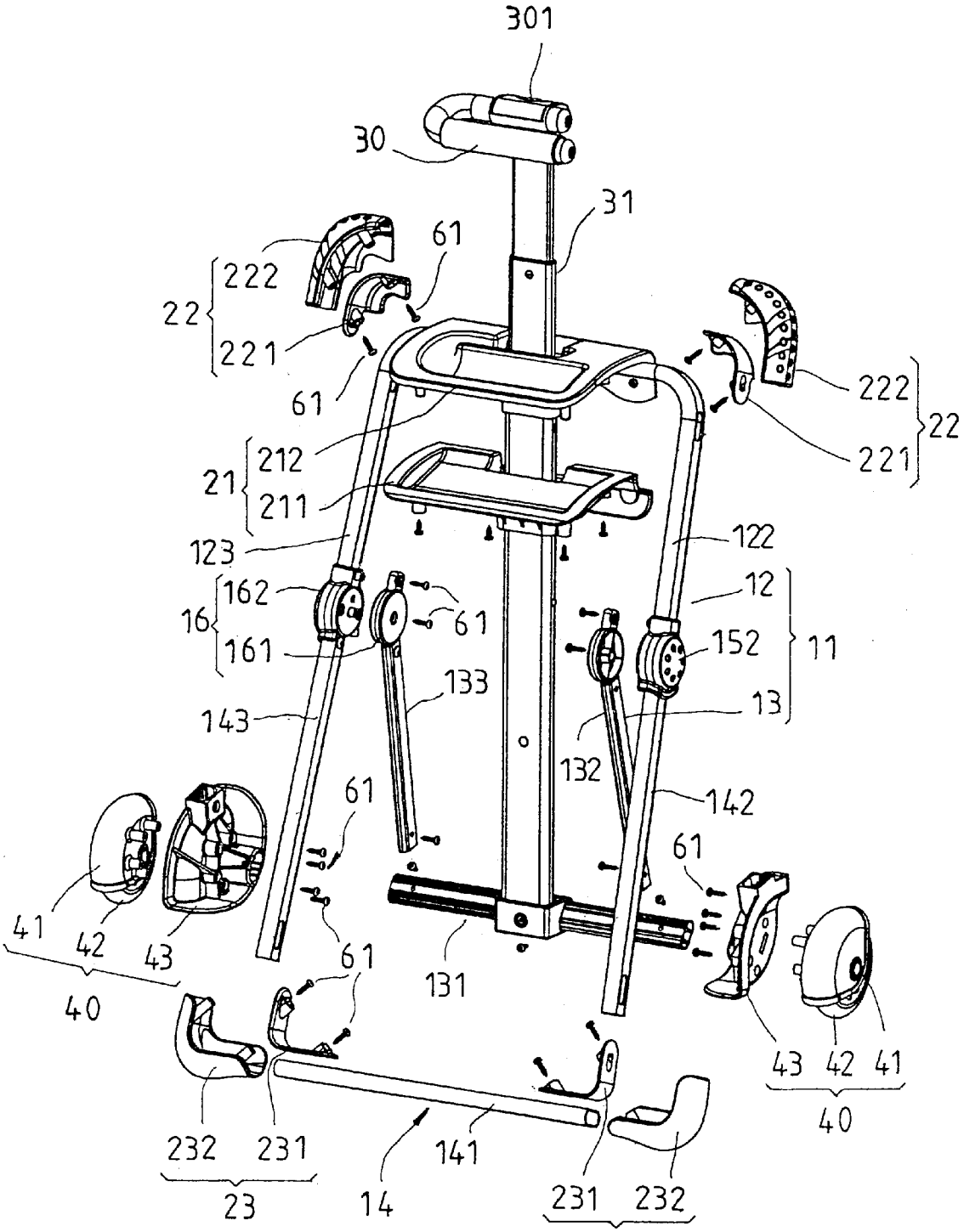
FIG. 2 is an exploded view of a frame body for luggage according to the present invention.
Figure 3:
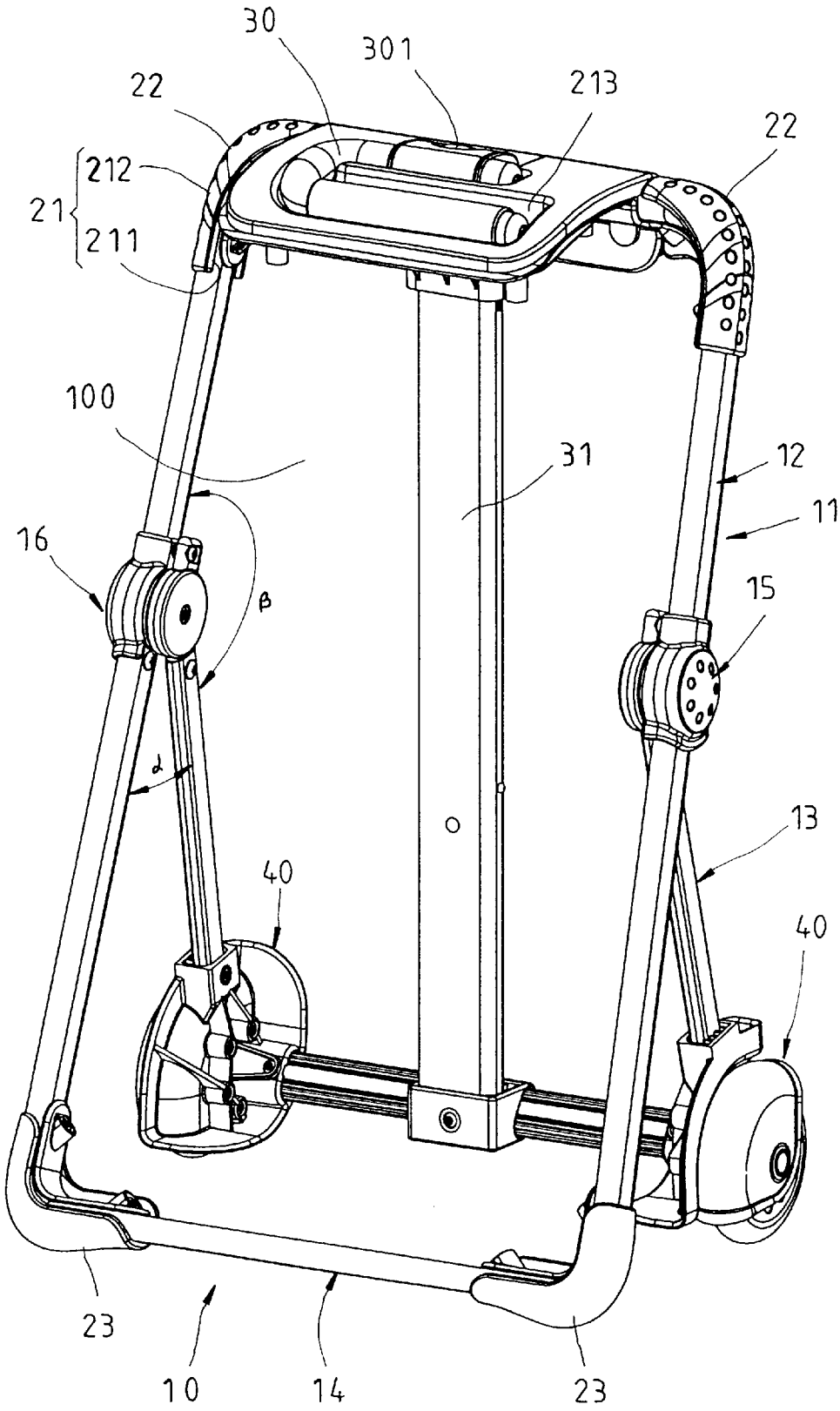
FIG. 3 is a perspective assembly view of the frame body for luggage according to the present invention.
Figure 4:
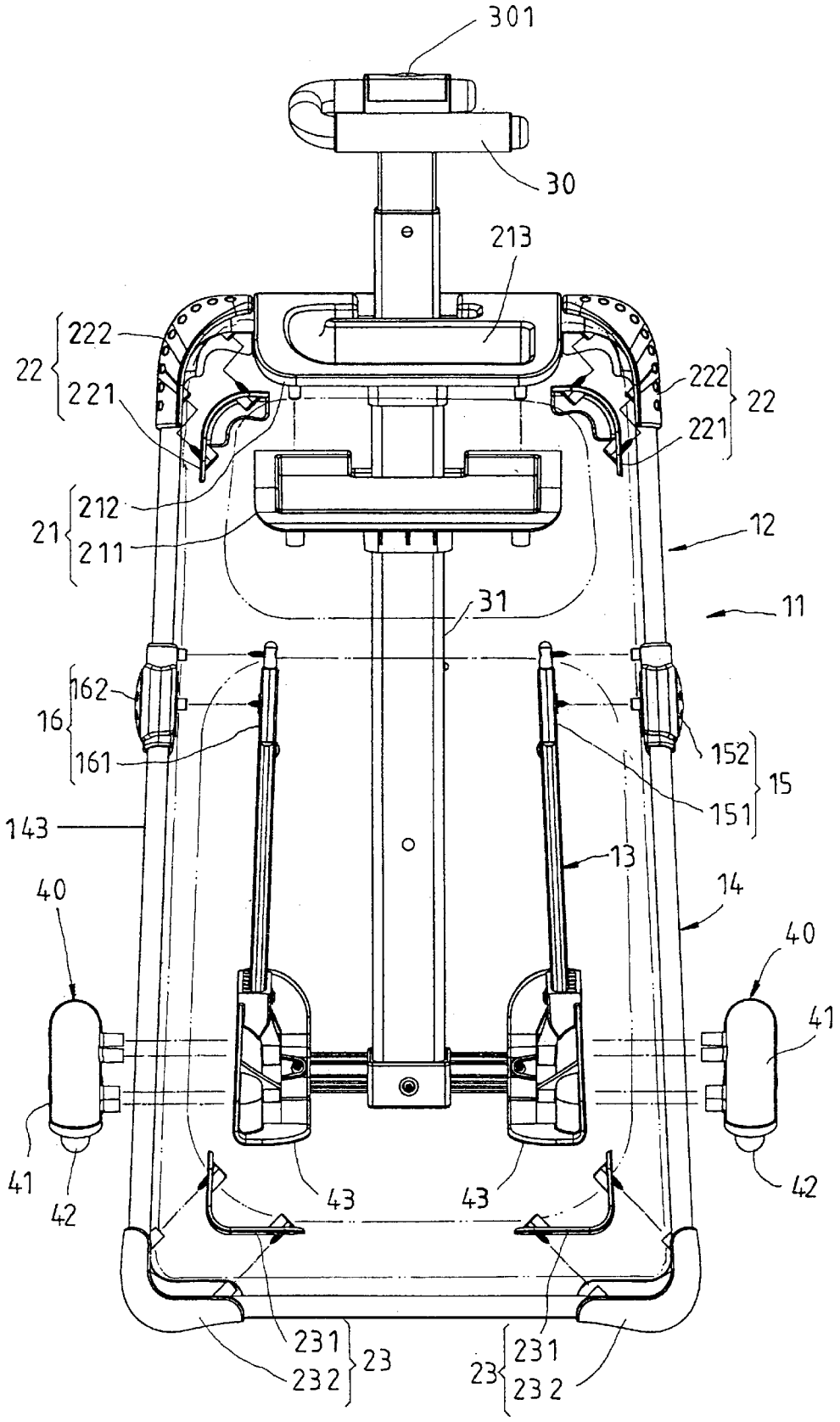
FIG. 4 shows the installation of the bag body in the frame body according to the present invention.
Figure 5:
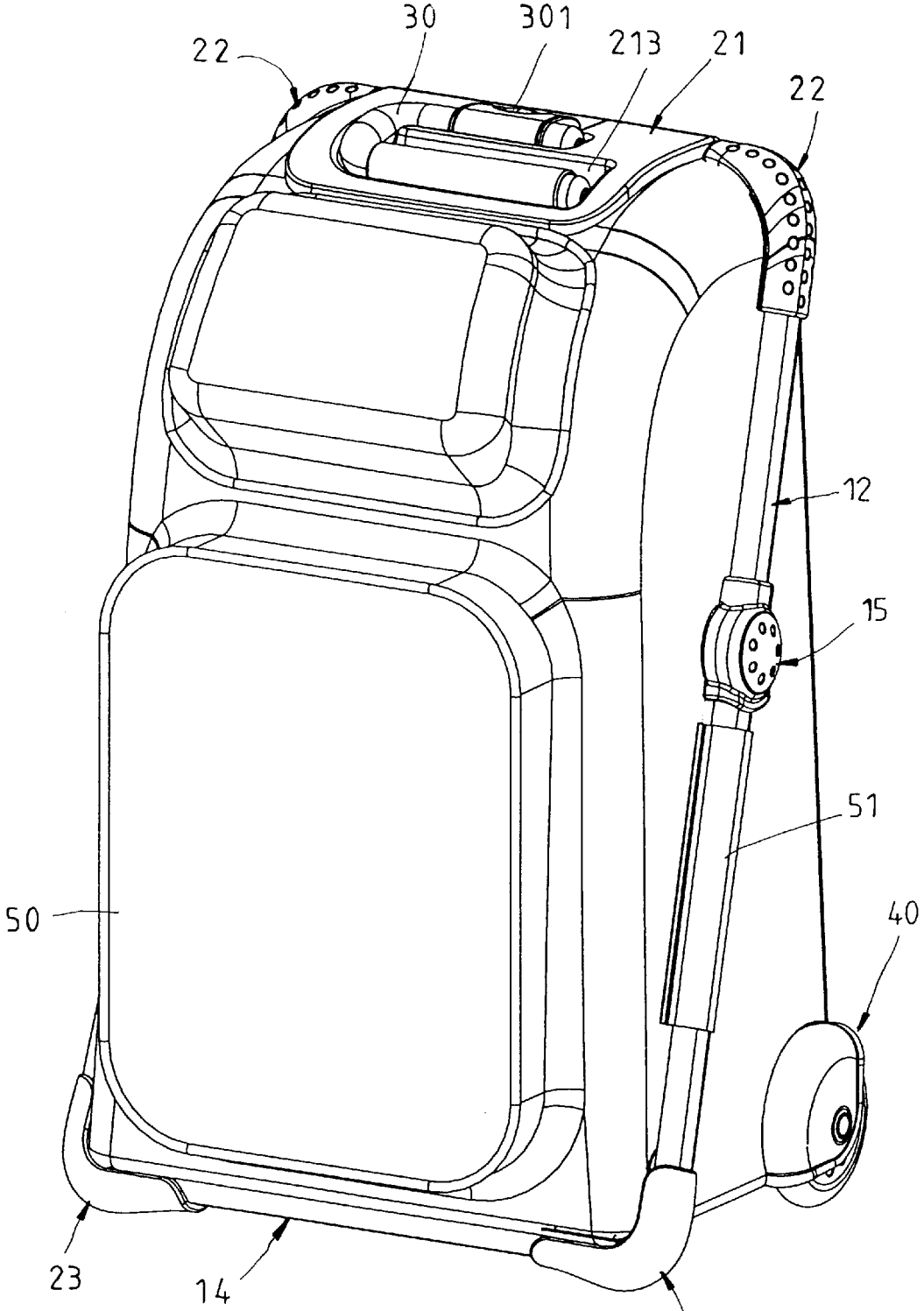
FIG. 5 is a perspective view of the luggage according to the present invention.
Figure 6:
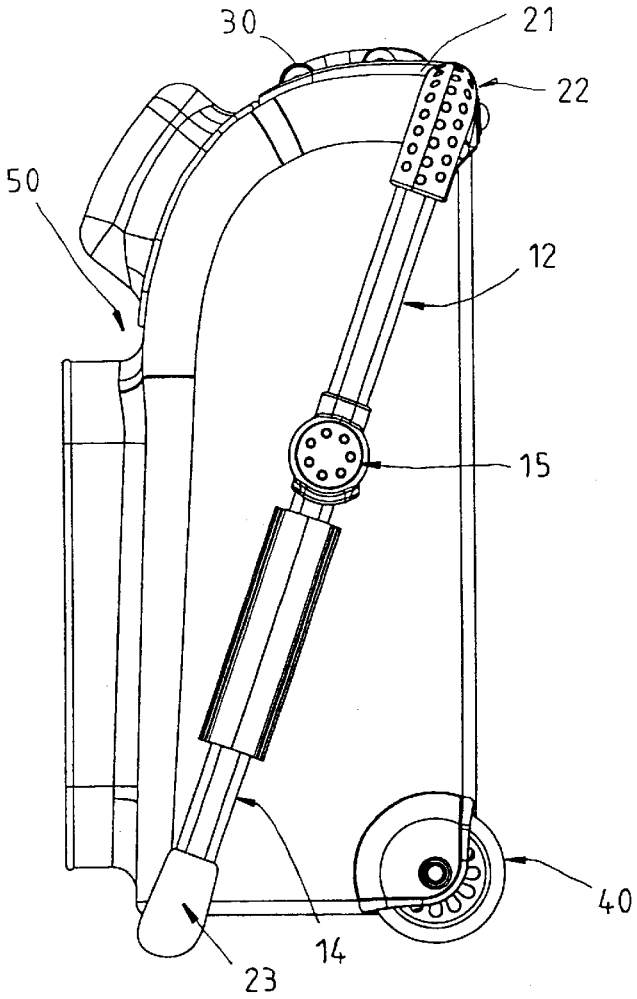
FIG. 6 is a side view of the luggage according to the present invention.

Referring to FIGS. from 2 through 7, a luggage in accordance with the present invention comprises a frame body 10, a main locating member 21, two upper locating members 22, two bottom locating members 23, a handgrip 30, two wheel assemblies 40, and a flexible bag body 50.

The frame body 10 comprises a main frame unit 11, and a side frame unit 14 connected to the main frame unit 11 at an angle ($\alpha$). The main frame unit 11 comprises a first frame 12 and a second frame 13. The first frame 12 comprises a transverse top frame bar 121 and two parallel side frame bars 122 and 123. The second frame 13 comprises a transverse bottom frame bar 131 and two parallel side walls 132 and 133. The side frame unit 14 comprises a transverse bottom frame bar 141, and two parallel side frame bars 142 and 143. Two coupling members 15 and 16 are provided to connect the side frame bars 122 and 123 of the first frame 12 to the side frame bars 132 and 133 of the second frame 13 and the side frame bars 142 and 143 of the side frame unit 14. The coupling members 15 and 16 each comprise an exterior piece 152 or 162 coupled between the bottom end of one side frame bar 122 or 123 of the first frame 12 and the top end of one side frame bar 142 or 143 of the side frame unit 14, and an interior piece 151 or 161 fixedly mounted on the top end of one side frame bar 132 or 133 of the second frame 13 and fastened to the corresponding exterior piece 152 or 162 by screws 61. When assembled, the side frame bars 122 and 132 of the first frame 12, and the side frame bars 132 and 133 of the second frame 13 define a contained angle ($\beta$), and the side frame unit 14 is pivoted to the main frame unit 11 to turn related to the main frame unit 11 within an predetermined angle.

The main locating member 21, the upper locating members 22 and the bottom locating members 23 each are comprised of an interior piece 211, 221 or 231, and an exterior piece 212, 222 or 232. The main locating member 21 is fastened to the transverse top frame bar 121 of the first frame 12. The upper locating members 22 are respectively fastened to the curved portions of the first frame 12 and connected between the two distal ends of the transverse top frame bar 121 and the two side frame bars 122 and 123. The bottom locating members 23 are respectively fastened to the side frame unit 14 and connected between the two distal ends of the transverse bottom frame bar 141 and the two side frame bars 142 and 143. The function of the main locating member 21, the upper locating members 22 and the bottom locating members 23 will be described further.

The wheel assemblies 40 each comprise a wheel frame 41, a wheel 42 pivoted to the wheel frame 41 and a wheel holder 43 respectively. The wheel frames 41 are connected to one side frame bar 132 or 133 and the ends of the transverse bottom frame bar 131 of the second frame 13 at an outer side respectively, and the wheel holder 43 is connected to the second frame 13 at an inner side. The wheel frame 41 is fixedly fastened to the respective wheel holder 43 by four screws 61. After installation of the wheel assemblies 40 in the second frame 13, the wheel assemblies 40 positively secure the side frame bars 132 and 133 to the transverse bottom frame bar 131.

Referring to FIGS. 4 to 7, the flexible bag body 50 is mounted in the holding space 100 in the frame body 10, and adapted to hold goods or clothes. After installation of the flexible bag body 50 in the frame body 10, the first frame 12 and the side frame unit 14 are disposed at the outer side of the flexible bag body 50, and the second frame 13 is disposed at the inner side of the flexible bag body 50. The flexible bag body 50 further comprises two coupling members 51 disposed at two sides and respectively secured to the side frame bars 142 and 143 of the side frame unit 14. The interior pieces 211, 221, 231 and 151 and the wheel holders 43 are disposed inside the flexible bag body 50 and respectively fixedly fastened to the respective exterior pieces 212, 222, 232 and 152 and the respective wheel frames 41 by screws 61, keeping the flexible bag body 50 positively secured to the frame body 10. By means of the wheel assemblies 40 and the transverse bottom frame bar 141 of the side frame unit 14, the luggage stands stably on a flat surface.

Figure 8:
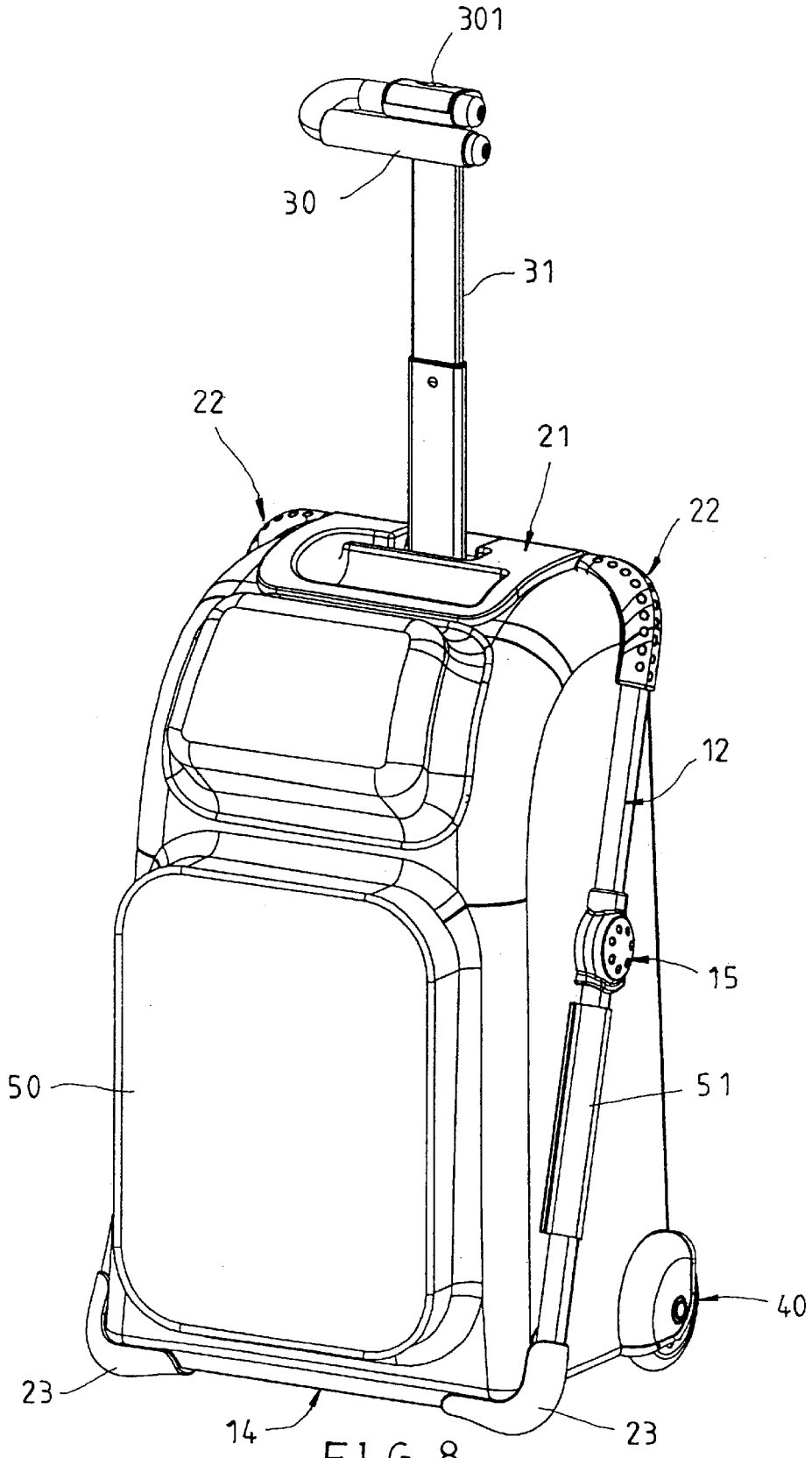
FIG. 8 is another perspective view of the present invention, showing the retractable handlebar in the extended position.
Figure 9:
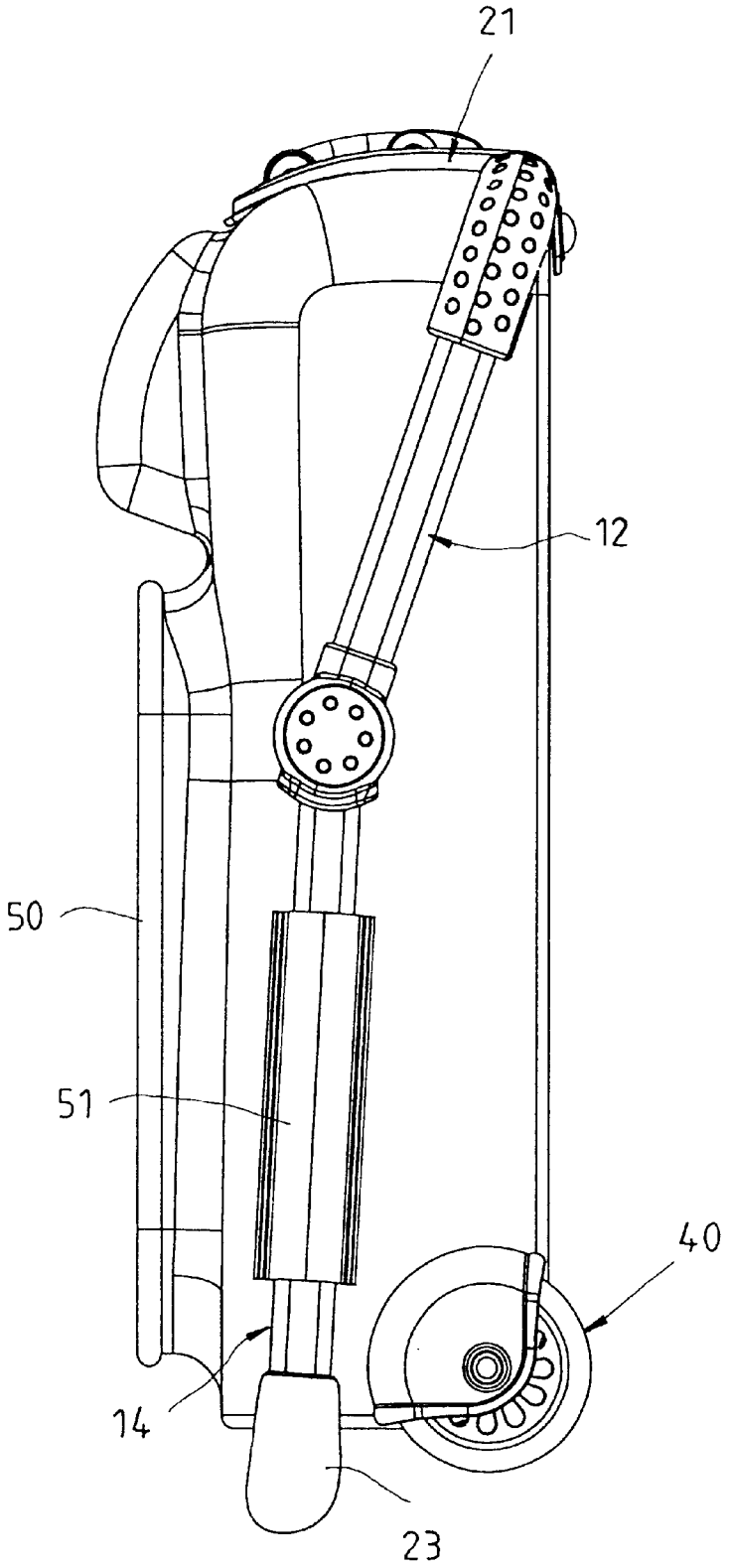
FIG. 9 is a side view of the present invention, showing the luggage collapsed.

Referring to FIG. 8, when in use, the control button 301 is depressed to unlock the retractable handlebar 31, and then the handgrip 30 is turned outwards from the recessed portion 213 of the main locating member 21 and pulled to extend out the retractable handlebar 31. When not in use, the control button 301 is depressed to unlock the retractable handlebar 31, enabling the retractable handlebar 31 to be moved from the extended position to the received position. When collapsed, the handgrip 30 is received in the recessed portion 213 of the main locating member 21 again.

Figure 7:
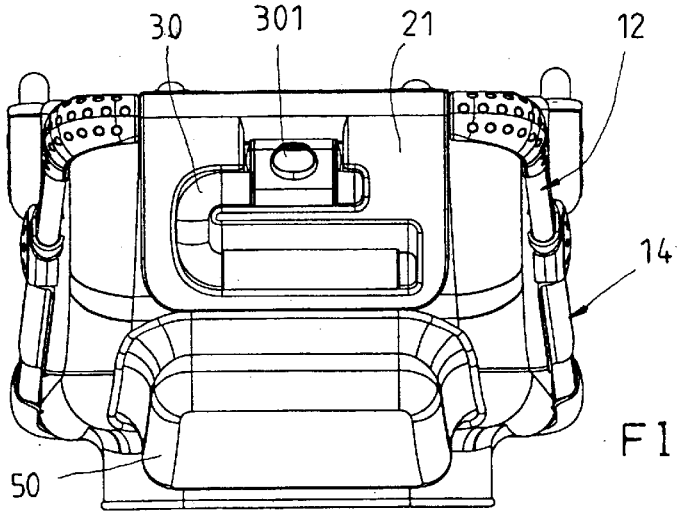
FIG. 7 is a top view of the luggage according to the present invention.

Referring to FIGS. 1 and 7, because the second frame 13 is connected to the first frame 12 at an angle (β), the retractable handle 31 can be installed in a position close to the center of gravity of the luggage (See FIG. 7). Therefore, the user can hold the handgrip 30 to carry the luggage by hand with less effort. This design eliminates the requirement for an additional carrying handle as required in prior art designs.

Further, the aforesaid design enables the user to detach the flexible bag body 50 from the frame body 10 for washing (the bag body of a conventional luggage is not detachable).

While only one embodiment of the present invention has been shown and described, it will be understood that various modifications and changes could be made thereunto without departing from the spirit and scope of the invention disclosed. For example, the side frame unit 14 can be pivoted to the main frame unit 11 and locked in one of a series of angles by lock means.

What the invention claimed is:

1. A luggage comprising:

a frame body defining a holding space, said frame body comprising a main frame unit and a side frame unit rotatably engaged to said mainframe unit so as to permit rotation of the side frame unit relative to the main frame unit within a predetermined angle;

said main frame unit having a first frame and a second frame fixed to said first frame at a predetermined angle;

a bag body, said bag body being installed in the holding space in said frame body, wherein said second frame is engaged to an inside wall of the bag body and said first frame and said side frame are engaged to an outside wall of the bag body;

a handle for holding by the user;

two wheel assemblies respectively mounted on a bottom side of said second frame, said wheel assemblies each comprising a wheel frame and a wheel pivoted to said wheel frame; and means for securing said bag body to said frame body.

2. The luggage of claim 1 further comprising two coupling members that engage said first frame and said second frame to said side frame unit.

3. The luggage of claim 2, wherein said coupling members each comprise an exterior piece disposed outside said bag body and coupled between said first frame and said side frame unit, and an interior piece disposed inside said bag body and fixedly mounted on said second frame and fastened to said exterior piece.

4. The luggage of claim 1, wherein said wheel assemblies each further comprise a wheel holder attached to said frame body at an inner side, and the wheel frame of each of said wheel assemblies is attached to said frame body at an outer side and fixed to the corresponding wheel holder.

5. The luggage of claim 4, wherein the wheel holders of said wheel assemblies are respectively attached to the inside wall of said bag body, and the wheel frames of said wheel assemblies are respectively attached to the outside wall of said bag body and respectively fixed to the wheel holders of said wheel assemblies to secure said bag body to said frame body.

6. The luggage of claim 1, wherein a main locating member, which comprises an interior piece attached to the inside wall of said bag body, and an exterior piece disposed outside said bag body and mounted on said frame body and fixed to the interior piece of said main locating member for securing said bag body to said frame body.

7. The luggage of claim 6, further comprising at least one auxiliary locating member, each of which comprises an interior piece attached to the inside wall of said bag body, and an exterior piece disposed outside said bag body and mounted on said frame body and fixed to the interior piece of said main locating member for securing said bag body to said frame body.

8. The luggage of claim 1, wherein said handle is a retractable handle comprising a retractable handlebar and a handgrip rotatably engaged to one end of said retractable handlebar for the holding of the hand to move said retractable handlebar between a received position and an extended position.

9. The luggage of claim 8, wherein said handgrip comprises a control button which controls the movement of said retractable handlebar between said received position and said extended position.

* * * * *